United States Patent [19]

Anten et al.

[11] Patent Number: 4,925,025

[45] Date of Patent: May 15, 1990

[54] POINT OF PURCHASE DISPLAY

[76] Inventors: Lewis Anten, 17423 Rancho; Arnold Rubin, 17437 Palora St., both of Encino, Calif. 91316

[21] Appl. No.: 357,115

[22] Filed: May 26, 1989

[51] Int. Cl.[5] ..... B65D 85/68

[52] U.S. Cl. ..... 206/335; 206/45.14; 206/45.34; 206/216; 206/579; 446/75; 446/484

[58] Field of Search ..... 206/45.34, 216, 461, 206/471, 579, 45.14, 45.31, 320, 335; 446/75, 439, 484

[56] References Cited

U.S. PATENT DOCUMENTS

| | | | |
|---|---|---|---|
| 3,533,503 | 10/1970 | Wood | 206/45.34 |
| 3,796,005 | 3/1974 | Chang et al. | 446/484 |
| 3,811,565 | 5/1974 | Tancredi | 206/45.34 |
| 3,847,276 | 11/1974 | Lehner et al. | 206/45.34 |
| 4,185,739 | 1/1980 | Wilford | 206/335 |
| 4,221,454 | 9/1980 | Wong | 446/484 |
| 4,261,466 | 4/1981 | Wilford | 206/335 |
| 4,767,374 | 8/1988 | Yang | 446/484 |
| 4,848,577 | 7/1989 | Hoffman et al. | 206/45.34 |

*Primary Examiner*—David T. Fidei
*Attorney, Agent, or Firm*—Lewis Anten

[57] ABSTRACT

A packaged toy having a temporary, inexpensive battery power supply, replaceable by conventional batteries for long term use, permits the creation of a point of purchase display, activated while in the package. Two circuits may be wired in parallel so that the temporary battery power supply is disconnected after the permanent power supply is placed in the unit.

9 Claims, 3 Drawing Sheets

POINT OF PURCHASE DISPLAY

BACKGROUND

The present invention relates to devices that are known as point of purchase displays in retail stores. It is common in the retail business, particularly in the toy industry, to have displays set up in the stores that permit the customers to see the actual operation of the toy. For example, if the toy is a talking teddy bear, a display will be set up where the talking teddy bear is shown in operation. Such devices are typically powered by an electrical power supply.

Delivery of the point of purchase display is difficult to coordinate with the stores, and also adds significantly to the cost of the toys. Also the point of purchase displays tend to break from consistent usage and thus must be replaced.

There have been toys that have had openings in the package permitting the operation of the toys. For example, talking toys having a pull string are common.

The present invention differs substantially from devices that have a backup battery for operation of a device where the primary battery power fails. Such devices are common in hand held electrical devices, such as electronic memo pads and the like. In the present invention, the two power supplies are intended to operate independently of each other. The inexpensive power supply is not intended serve as a backup power supply, but rather to be the principal power supply for operating the device in the point of purchase display or until the permanent power supply is installed.

SUMMARY OF INVENTION

In the present invention, a battery powered toy, has installed in the package at the factory, low cost button batteries, such as used in watches, for powering the electrical circuitry. The button batteries are held in a disposable pack within the battery compartment sized for normal AA batteries. The disposable battery pack is smaller than the normal batteries, typically AA batteries, and has means for holding the disposable battery pack fixed against the electrical contacts at one end of the battery compartment. The toy is placed in a box or on a blister card and has an opening so that the buttons for activating the toy can be pressed, causing the toy to be operated. When the box is opened the disposable button battery pack is removed, and two AA batteries installed in the battery compartment.

In an alternative embodiment, two circuits are provided and connected in parallel so that the electronic circuitry can be activated by either the replaceable batteries or the two AA batteries. Thus, the device could be operated by the low cost button batteries installed at the factory, and the purchaser of the toy could then install the conventional batteries for long term use.

OBJECTS OF THE INVENTION

It is an object of the present invention to provide an improved point of purchase display;

It is another object of the present invention to provide an improved point of purchase display which is cheaper;

It is also an object of the present invention to provide an improved point of purchase which is more convenient.

It is another object of the present invention to provide an improved point of purchase display which is more reliable.

These and other objects of the present invention will be apparent from a review of the following specification and the accompanying drawings.

DETAILED DESCRIPTION OF THE DRAWINGS

Figure 1:
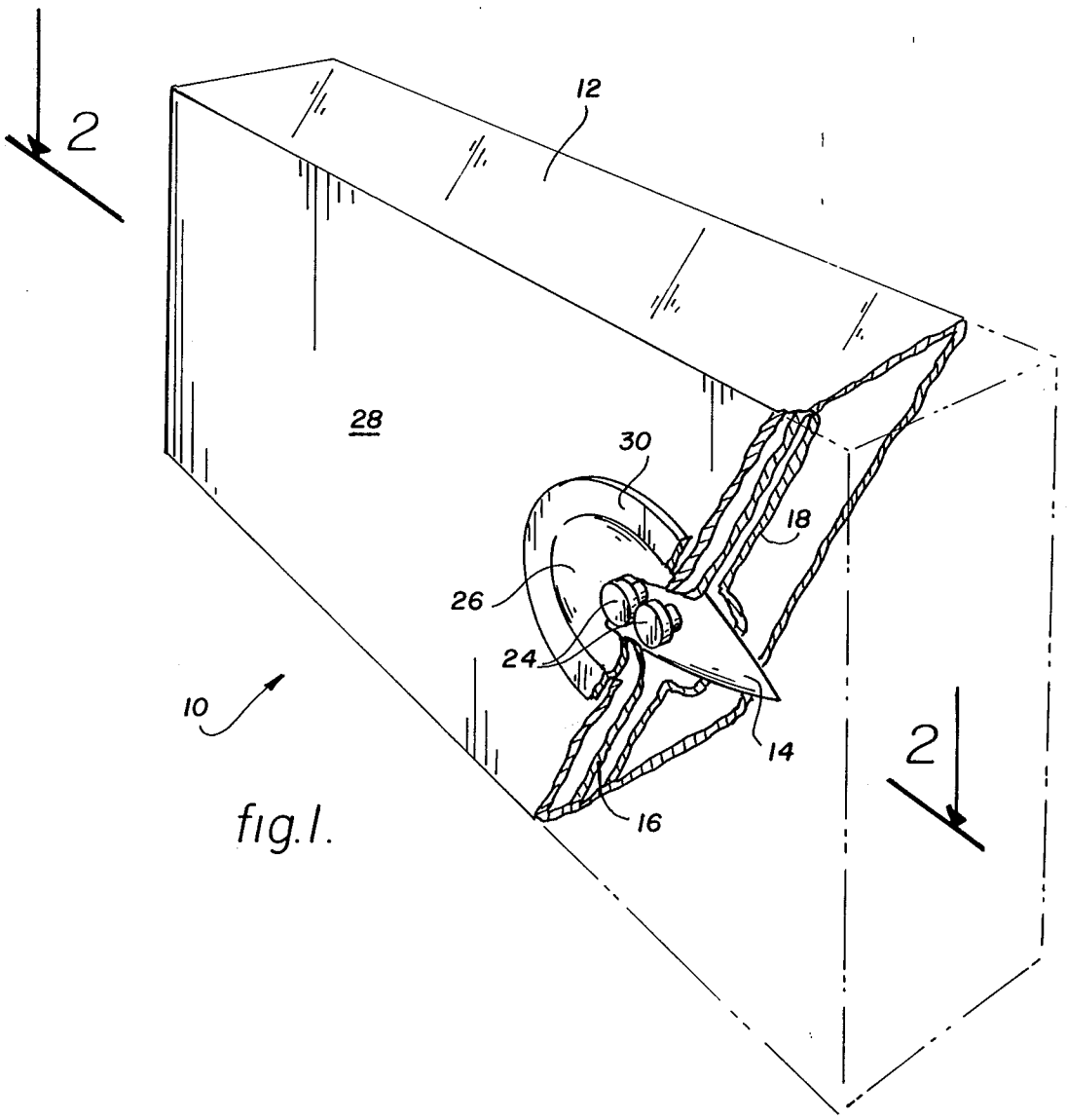
FIG. 1 is a bottom partial sectional perspective view of the point of purchase display of the present invention.
Figure 2:
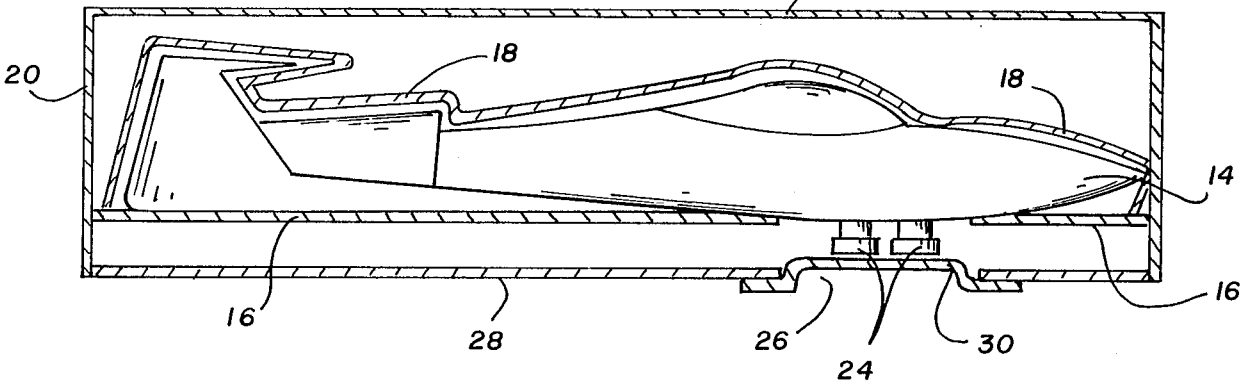
FIG. 2 is a side sectional view of the point of purchase display of FIG. 1 taken along lines 2—2 of FIG. 1.

Referring to FIGS. 1 and 2 the present invention is shown. The Point of Purchase display 10 consists of a box 12, containing a toy 14 which is mounted on an internal cardboard backing card 16. The toy 16 is covered by a transparent blister 18. The top 20 of the box 12 has a transparent plastic portion 22 for viewing the toy 14.

The toy 14 has activation buttons 24 which are accessible through an opening 26 in the bottom 28 of the box 12. The opening 26 may be covered by a reinforced plastic membrane 30.

Figure 4:
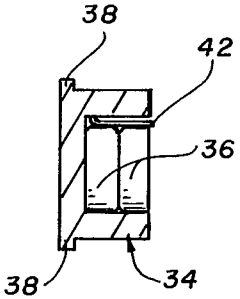
FIG. 4 is a side sectional view of the temporary battery pack and button batteries.
Figure 3:
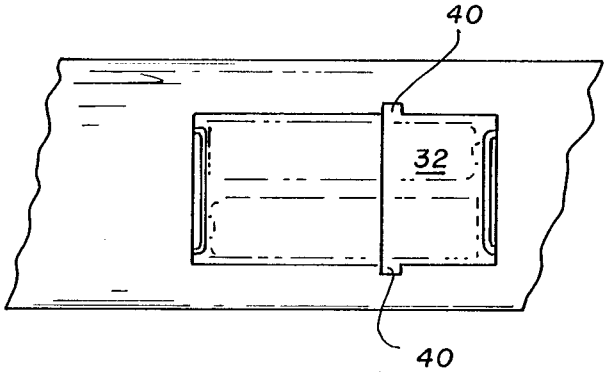
FIG. 3 is a bottom partial view of the battery compartment of the toy.

Referring to FIGS. 3 and 4, the bottom of the toy has a battery compartment 32 which is typically covered by a cover, not shown. The battery compartment is dimensioned so as to receive two AA batteries. However, other sized batteries may be used. In the point of purchase display 10, a temporary battery pack 34 having two button batteries 36, is installed in the battery compartment 32. The battery pack 34 has projections 38 for engaging slots 40 in the battery compartment 32. Electrical contact 42 connects the circuit for the battery pack 34 with the first power supply 100 connected in parallel to a second power supply 102, consisting of a conventional AA batteries. The power supply activates the electrical device 104 of the toy.

As the buttons 24 are is depressed it closes the circuits of both the first and second power supplies 100 and 102. Thus, the electrical circuit 104 will operate as long as either the first 100 or second power supply 102 is in place.

Figure 6:
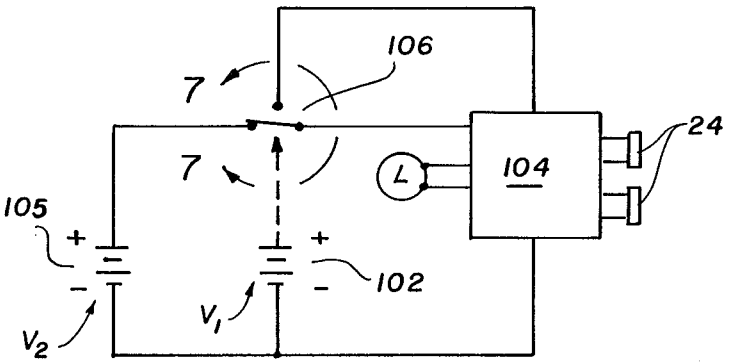
FIG. 6 is an alternative circuit diagram of the present invention.
Figure 7:
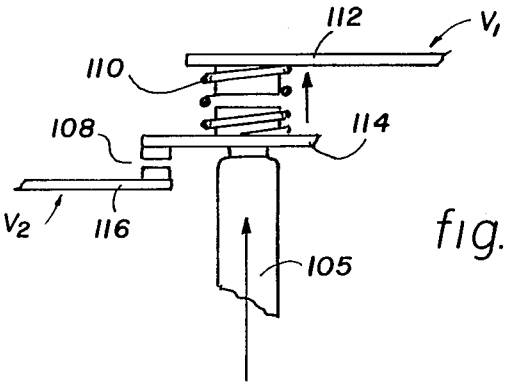
FIG. 7 is an embodiment of the present invention for mechanically disengaging the first battery circuit when the regular batteries are installed in the second circuit.

Referring to FIG. 6 and 7, a spring switch 106 is shown which serves to disconnect the button batteries 102 from the circuit when the permanent AA batteries 104 are installed. In the absence of the permanent battery 104, the spring 110 causes upper contact 114 to be in electrical connection with control 116. Further, by disconnecting the button battery 102 the current to the circuit 104 will not be increased during the time that both battery power supplies are present, causing a decrease in the current to the electronic circuit 104 causing the user to believe that the device was defective.

Figure 5:
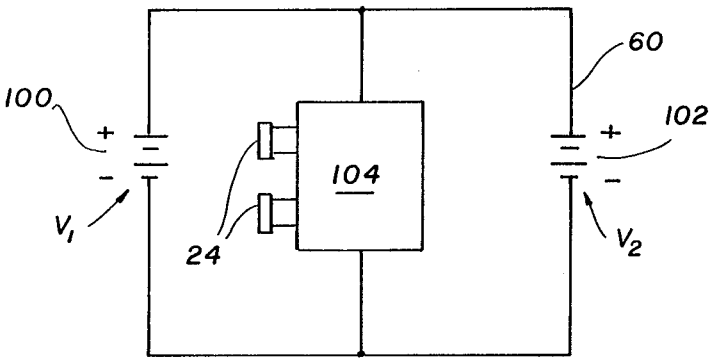
FIG. 5 is a circuit diagram of the dual power supply circuit.

The operation is as follows: The button batteries are installed at the factory either in the battery compartment 32 or in the body of the toy 14. The button batteries may be either replaceable or built in the toy 14 in such a manner that they are not accessible, but remain in the toy 14 and are operable until they die either by continuous use as in FIG. 5, or when used only when the regular AA batteries 104 are not in place. In the latter case, the button batteries 102 serve a dual function as back up batteries in the battery compartment 32 or the body of the toy 14. The toy is then installed in a closed box on a cardboard backing 16, and covered by a blister 16, to hold it in place. Other conventional packaging configurations could also be used such as blister cars and the like. The packaging includes an opening 26 on the bottom 28 of the packaging aligned with the buttons 24 of the toy 14. The user can pass his finger into the opening 24 so that the buttons can be activated operating the toy 14. The flexible membrane 30 minimizes tearing of the package 12. The disclosed invention permits every unit to be a point of purchase display. The use of the button batteries for the first inexpensive power supply 100, being much less costly than conventional AA batteries, does not add significantly to the cost of the toy 14. At the same time, the stores still have the opportunity to sell the retail customer conventional AA batteries for permanent use. The button batteries have long shelf life and are unlikely to cause damage from leakage. If they do die while on the shelf, the toy 14 is still operable by use of regular AA batteries.

Due to the desirability of keeping the cost of toys as low as possible, it is preferable that the means for disengaging the inexpensive power supply be mechanical, although an electrical disengaging means may also be used.

In its preferred embodiment the point of purchase device 10 of the present invention as used for a toy jet plane, having a button 24 for activating a sound simulating chip and LED lights. It is recognized however, that the point of purchase display could be used for any device. Further, it is recognized that more sophisticated circuitry can be incorporated in the present device for the purpose of regulating the current. It is intended that such variations and alternative embodiments be considered within the present inventive concept.

What is claimed is:

1. A point of purchase display including a battery operated device having a means for activating said device within a package having a battery compartment, a first relatively inexpensive battery supply within said battery compartment, said inexpensive battery supply being smaller than said compartment, said means for activating said device being accessible from outside of said package.

2. The point of purchase display of claim 1 in which said first relatively inexpensive battery includes at least one button battery, said button battery fitted within a battery pack within said battery compartment.

3. The point of purchase display of claim 2 in which said battery compartment is the size of AA batteries.

4. The point of purchase display of claim 1 including at least one opening in the package to access said means for activating said device.

5. The point of purchase display of claim 4 in which said opening is covered by a plastic membrane.

6. A point of purchase display for a battery operated toy comprising a toy within a package, said toy operable from the outside of the package, said toy having a battery operable circuit operable by means of a first battery power supply, and a second battery circuit, said first battery connected in parallel with said second battery power supply, said toy having installed within said packaging a first relatively inexpensive battery supply, said circuit being operable without opening said package.

7. A battery operated point of purchase display for a battery operated toy, comprising a toy within a package, said toy having a battery powered circuit means for activating said toy without removing said toy from said package, said toy having a first circuit connected in parallel to a second circuit, said first circuit being disengaged when a second power supply is installed in the toy after removal from said package.

8. The point of purchase display of claim 7 in which said first circuit is mechanically disconnected upon installation of batteries in the second circuit.

9. The point of purchase of claim 8 in which said means for activating said circuit is accessible through an opening in said packaging.

* * * * *